US007699105B2

(12) United States Patent
Martinez

(10) Patent No.: US 7,699,105 B2
(45) Date of Patent: Apr. 20, 2010

(54) GRAVEL/FRAC PACKING

(75) Inventor: Samuel Martinez, Cedar Hill, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 55 days.

(21) Appl. No.: 12/116,720

(22) Filed: May 7, 2008

(65) Prior Publication Data

US 2009/0277624 A1 Nov. 12, 2009

(51) Int. Cl.
*E21B 43/04* (2006.01)

(52) U.S. Cl. ..... 166/278; 166/51

(58) Field of Classification Search ..... 166/278, 166/51

See application file for complete search history.

(56) References Cited

U.S. PATENT DOCUMENTS 3,072,204 A * 1/1963 Brown ..... 175/230
5,636,691 A 6/1997 Hendrickson et al.
5,871,050 A * 2/1999 Dobson et al. ..... 166/278
6,065,535 A * 5/2000 Ross ..... 166/51
6,464,006 B2 * 10/2002 Womble ..... 166/276
6,491,097 B1 12/2002 Oneal et al.
6,782,948 B2 * 8/2004 Echols et al. ..... 166/278
7,243,723 B2 7/2007 Surjaatmadja et al.
7,559,357 B2 * 7/2009 Clem ..... 166/51
2006/0191685 A1 8/2006 Coronado
2007/0051507 A1 3/2007 Ross et al.
2007/0251690 A1 * 11/2007 Whitsitt et al. ..... 166/278
2008/0099194 A1 * 5/2008 Clem ..... 166/51
2009/0025923 A1 * 1/2009 Patel et al. ..... 166/51

* cited by examiner

*Primary Examiner*—Shane Bomar
(74) *Attorney, Agent, or Firm*—Joshua A. Griswold

(57) ABSTRACT

Methods, systems, and tools for provide for delivering a particulate-laden slurry to a subterranean portion of a well for operations including gravel packing and/or frac packing.

17 Claims, 6 Drawing Sheets

GRAVEL/FRAC PACKING

BACKGROUND

The present disclosure relates to delivering a particulate-laden slurry to a subterranean portion of a well for operations including gravel packing and/or frac packing.

In gravel packing and frac packing, a particulate-laden slurry is pumped into the well bore through a tubing. The slurry is communicated from the interior of the tubing to an annulus between sand control screens of the production string and the wall of the well bore (open or cased) via a cross-over tool. The particulate in the slurry is deposited in the annulus about the sand screens to pack the annulus. In frac packing, the particulate is placed in connection with a fracing operation. In gravel packing, the zone about the well bore may or may not have been fraced, but the particulate is placed in a separate operation.

SUMMARY

In one aspect, a system for gravel packing a well bore includes: a production string comprising a sand screen; and a cross-over tool for communicating a particulate-laden slurry from an interior of a downhole work string to an exterior of the downhole work string. The tool includes: an elongate tubular body having an upstream end and a downstream end, the body defining an interior, axial bore open at the upstream end of the body to receive a flow of slurry; a discharge section of the body, the discharge section including at least one lateral slurry port extending through the body from the interior bore to an exterior surface of the body, the discharge section extending from an upstream end of the discharge section at an upstream edge of a farthest upstream one of the at least one lateral slurry port to a downstream end of the discharge section at a downstream edge of a farthest downstream of the at least one lateral slurry port; and a first transverse distance measured from a central axis of the body to the exterior surface of the body at the upstream end of the discharge section is greater than a second transverse distance measured from the central axis of the body to the exterior surface of the body at the downstream end of the discharge section.

In one aspect, a cross-over tool for communicating a particulate-laden slurry from an interior of a downhole work string to an exterior of the downhole work string includes: an elongate tubular body having an upstream end and a downstream end, the body defining an interior, axial bore open at the upstream end of the body to receive a flow of slurry; a discharge section of the body, the discharge section including at least one lateral slurry port extending through the body from the interior bore to an exterior surface of the body, the discharge section extending from an upstream end of the discharge section at an upstream edge of a farthest upstream one of the at least one lateral slurry port to a downstream end of the discharge section at a downstream edge of a farthest downstream of the at least one lateral slurry port; and a first transverse distance measured from a central axis of the body to the exterior surface of the body at the upstream end of the discharge section is greater than a second transverse distance measured from the central axis of the body to the exterior surface of the body at the downstream end of the discharge section.

Embodiments of the systems and/or tools can include one or more of the following features.

In some embodiments, the body defines a recessed flow area extending axially along the exterior of the body between the lateral slurry port and the downstream end, and a largest dimension measured along a radius of the cross-over tool at the upstream end of the body is larger than a largest dimension measured along a radius of the cross-over tool at the recessed flow area. In some cases, the recessed flow area extends around an entire perimeter of cross-over tool.

In some embodiments, the tool has a largest dimension measured along a radius of the cross-over tool located between the discharge section and the upstream end of the tool.

In some embodiments, a largest dimension measured along a radius of the cross-over tool in the discharge section decreases with increasing distance from the upstream end of the discharge section towards the downstream end of the discharge section. In some cases, a ratio of an average largest dimension of the tool divided by a maximum largest dimension of the tool is less than 0.75 (e.g., less than 0.7, 0.65). In some cases, a ratio of the average largest dimension of the discharge section to a maximum largest dimension of the discharge section of the tool is less than 0.75 (e.g., less than 0.7, 0.65).

In some embodiments, a transverse distance measured from a central axis of the body to an interior surface of the body at the upstream end of the discharge section is greater than a transverse distance measured from the central axis of the body to the interior surface of the body at the downstream end of the discharge section.

In some embodiments, the body comprises an outer member and an insert coaxially received within the outer member, and wherein the outer member comprises a first material and the insert comprises a second material that is harder than the first material. In some cases, the insert defines first apertures extending therethrough and the outer member defines second apertures ext ending therethrough and a plurality of first apertures are aligned with each second aperture.

In one aspect, a method of gravel-packing includes: communicating a particulate laden slurry in a work string to an outside of the work string with a cross-over tool, and communicating the slurry into an annulus between a sand screen and the well bore. The tool includes: an elongate tubular body having an upstream end and a downstream end, the body defining an interior, axial bore open at the upstream end to receive a flow of slurry; a discharge section of the body, the discharge section including at least one lateral slurry port extending through the body from the interior bore to an exterior surface of the body, the discharge section extending from an upstream end at an upstream edge of a farthest upstream one of the at least one lateral slurry port to a downstream end at a downstream edge of a farthest downstream of the at least one lateral slurry port; and a first transverse distance measured from a central axis of the body to the exterior surface of the body at the upstream end of the discharge section is greater than a second transverse distance measured from the central axis of the body to the exterior surface of the body at the downstream end of the discharge section.

In some embodiments, the method also includes returning fluid up through the cross-over tool.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
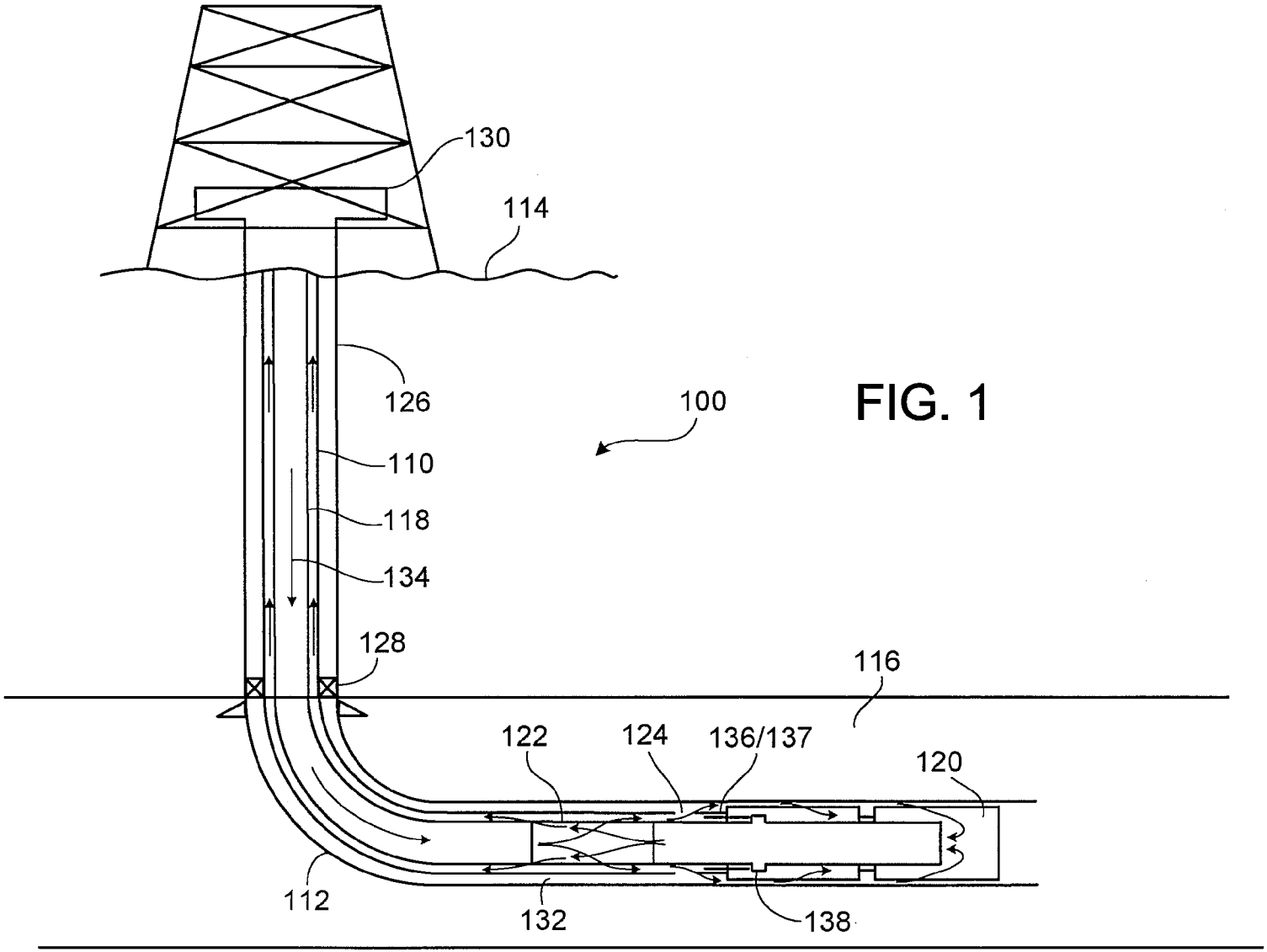
FIG. 1 is a cross-sectional view of a system for delivering a particulate-laden slurry to a well.

Referring to FIG. 1, a system 100 delivers a particulate-laden slurry to the annulus between a production string 110 and walls of a well bore 112. The well bore 112 extends from a terranean surface 114 to a subterranean zone 116 of interest. Production string 110 includes sand control screens 120 through which fluids (e.g., oils or gases) are introduced into production string 110. A working string 118 is inserted downhole within the production string 110 to deliver the slurry to the annulus between the sand screens 120 and the walls of bore 112. The working string 118 includes a cross-over tool 122 which is configured to transfer slurry being pumped through a bore of the working string 118 into the annulus between the working string 118 and the production string 110 and then through ports 124 in a window-sleeve sub 136 of production string 110 into the annulus between the production string 110 and the walls of the well bore 112.

A casing 126 forms the walls of a portion of the well bore 112. For example, the casing 126 can be installed extending from a well head 130 (located at the surface 114) to the top of subterranean zone 116 with the remainder of the bore 112 being an open hole 132. In certain embodiments, casing 126 can be extended through the subterranean zone 116 and be perforated to allow communication between the well bore 112 and the subterranean zone 116. In certain instances, the casing 126 can line the entire length of the well bore 112. Also, although well bore 112 is shown as a horizontal well bore, well bore 112 can have other configurations. For example, the well bore 112 can be entirely vertical, can slant, or can have one or more laterals, can reach multiple subterranean zones and/or other configurations.

The production string 110 is installed extending downhole from the well head 130 into the subterranean zone 116. The production string 110 includes sand screens 120 (two shown, but one or more can be provided) and window-sleeve sub 136 mentioned above. The sand screens 120 are configured to filter particulate matter from the flow into the production string 110. In certain instances, the sand screens 120 can be a wire wrapped screen, a packed screen, an expanded screen, and/or other type of well screen. The window-sleeve sub 136 includes a port 124 extending through a side wall of the production string 110. The port 124 provides fluid communication between an interior of the production string 110 and the annulus between the production string 110 and well bore 112. The window-sleeve sub 136 includes a sleeve 137 which can be moved to selectively cover and uncover the port 124 to selectively limit (e.g., prevent) fluid communication.

A packer 128 carried by the production string 110 is set to seal against the casing 126 and limit (e.g., to prevent) fluid flow in the annulus between the production string 110 and the bore hole 112. The packer 128 can be installed, as shown, at or near the top of the subterranean zone 116 to isolate the subterranean zone. Certain embodiments of system 100 are implemented without a packer 128.

The working string 118 includes the cross-over tool 122 (described in more detail below) and a window-sub actuation tool 138. The working string 118 is inserted downhole within the production string 110 until the cross-over tool 122 is slightly uphole of the ports 124 of the window-sleeve sub 136. The slurry containing particulate matter is pumped down the bore of the working string 118, and into the annulus between the working string 118 and the production string 110 via the cross-over tool 122. The slurry continues through the open ports 124 of the window-sleeve sub 136 and into the well bore 112 around the sand screens 120. The particulate (e.g., gravel, proppant and/or other particulate) is deposited around the sand screens 120 where it can provide structural support to position the sand screens 120 within the well bore 112 and/or can provide an initial filtering of fluids flowing into the sand screens 120.

The flowing slurry containing the particulate is abrasive in nature. Components that participate in changing the direction of the slurry flow are subject to erosion, and more so when the change of direction is more abrupt. During the particulate matter deposition (e.g., gravel packing) process, the slurry experiences changes of direction in the cross-over tool 122 and portions of the production string 110 adjacent the flow exit of the cross-over tool 122. This erosion can cause accelerated wear, points of weakness and/or holes in the working string 118 and production string 110.

In some embodiments, as shown, the fluids from the slurry are pumped back to the surface 114, initially through the working string 118 below the cross-over tool 122 and then through the annulus outside of the working string 118. The cross-over tool 122 of FIG. 1 is configured with returns flow paths that communicate return fluids being pumped into the bore of the working string 118 below the cross-over tool 122 out into the annulus outside of the working string 118. In certain embodiments, often referred to as a squeeze packing, the fluids from the slurry are not returned or are only partially returned to the surface. The fluids not returned to the surface are dispersed into the subterranean zone.

After the completion of particle deposition (e.g., gravel packing), the working string 118 is withdrawn from the production string 110. As the working string 118 is withdrawn, the window-sub actuation tool 138 engages the sleeve 137 and closes the ports 124 by drawing the sleeve 137 over the ports 124. Thereafter, communication through the ports 124 is limited (e.g. prevented).

Figure 2A:
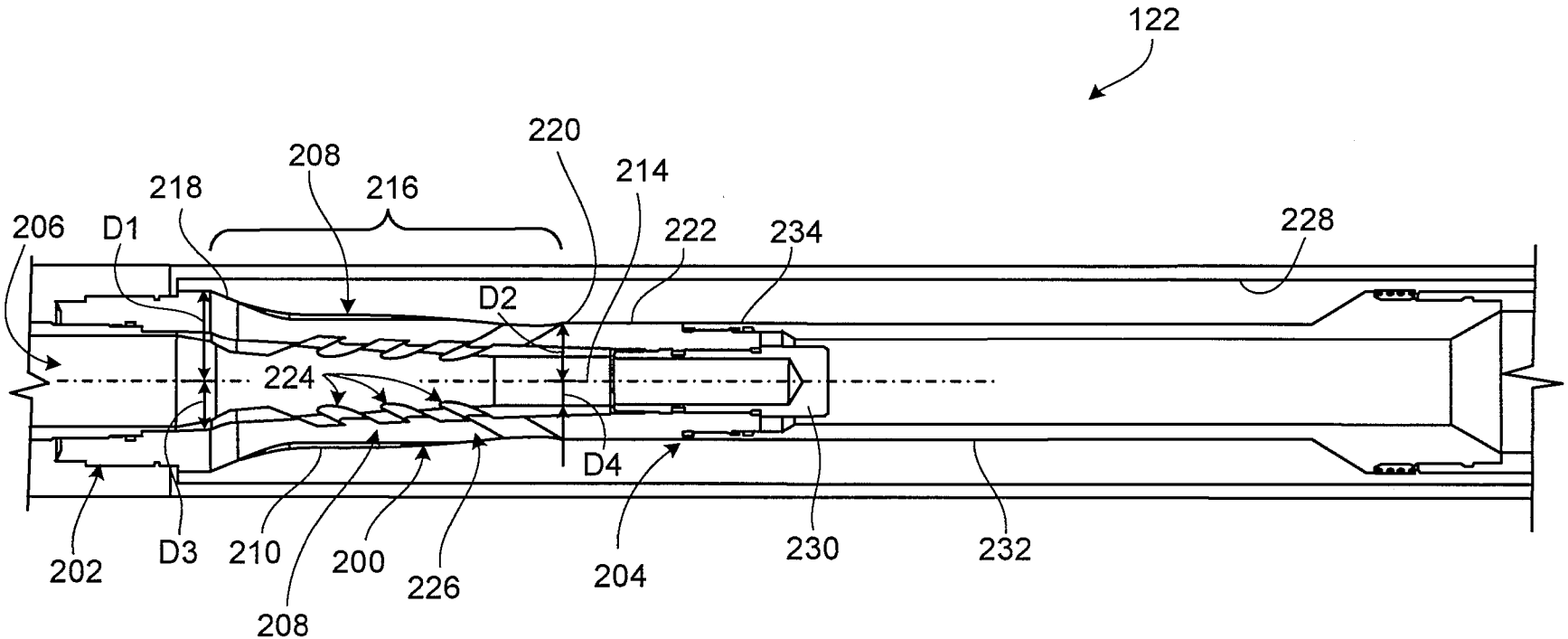
FIGS. 2A and 2B are, respectively, perspective and cross-sectional views of a cross-over tool for use in the system of FIG. 1.
Figure 2B:
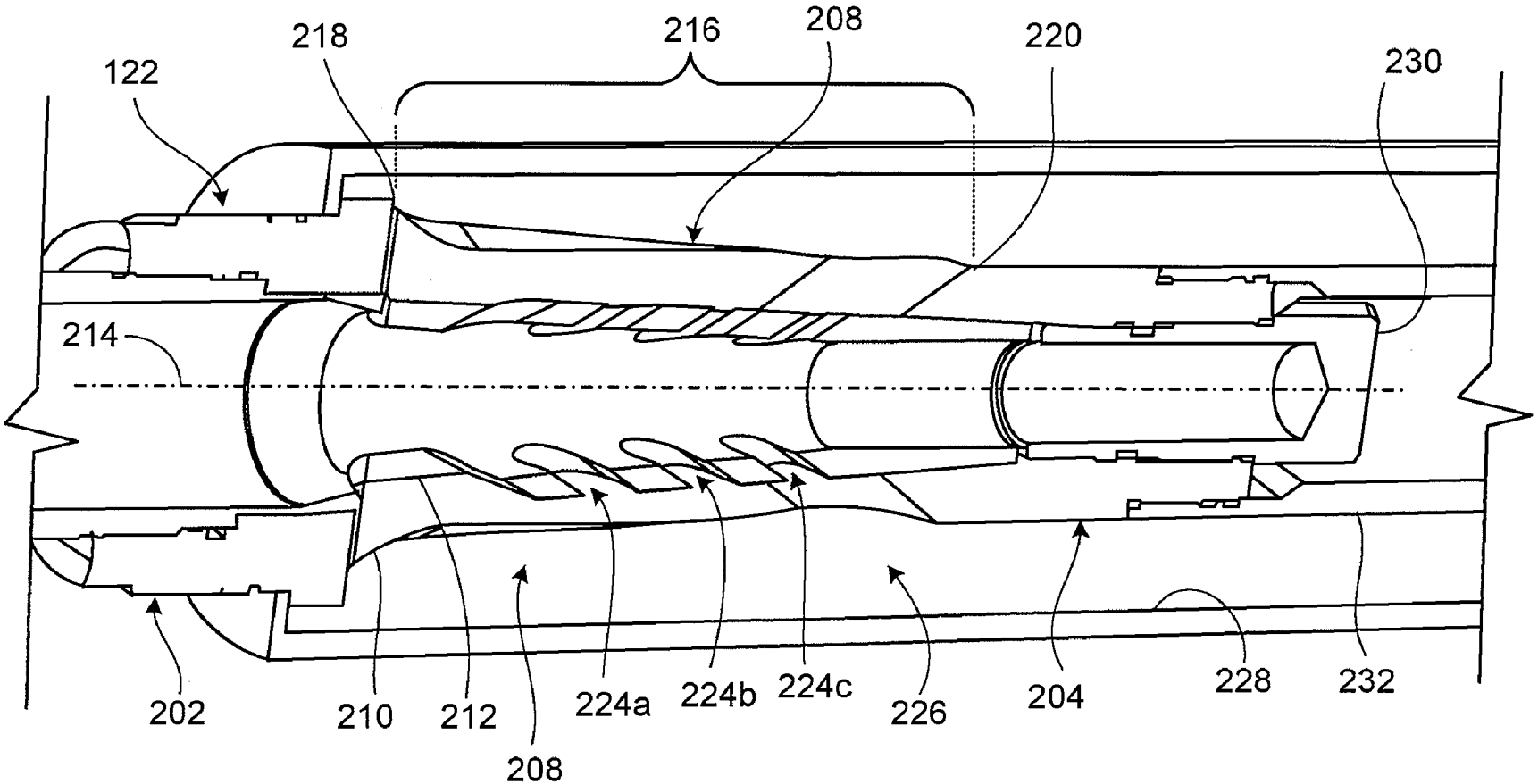

Now referring to FIGS. 2A and 2B, the cross-over tool 122 has an elongate tubular body 200 having an upstream end 202 and a downstream end 204. The slurry generally flows from the upstream end 202 toward the downstream end 204. The body 200 has a central longitudinal axis 214, and defines an interior, axial bore 206 that is open at the upstream end 202 to receive a flow of slurry. The body also includes a discharge section 216 including two, diametrically opposed lateral slurry ports 208 extending through the body 200 from the interior bore 206 to an exterior surface 222 of the body 200. In certain instances, at least one lateral slurry port 208 is provided. In certain instances, three, four or more lateral slurry ports 208 are provided. Although shown in FIG. 1 as having a circular cross-section, the tubular body 200 can have cross-sections of other regular and irregular shapes.

Figure 3:
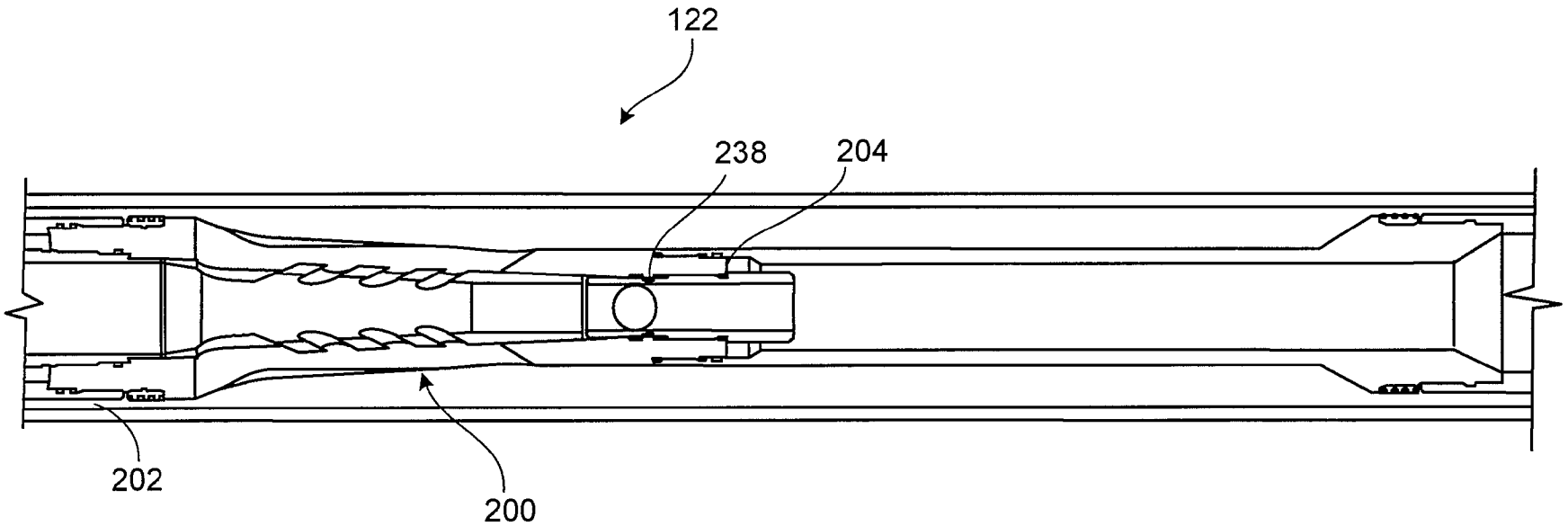
FIG. 3 is a cross-sectional view of another embodiment of a cross-over tool.

The downstream end 204 of the cross-over tool 122 is closed by a plug 230 which threadingly engages interior surfaces of the downstream end 204 of the body 200. In other embodiments, valves (e.g., a valve seat configured to be engaged by a ball dropped down the work string and/or another type of valve) can be used to close the downstream end 204 of the cross-over tool 122. For example, a cross-over valve 122 incorporating a ball drop valve 238 is shown in FIG. 3 Closure of the downstream end 204 of the cross-over tool 122 limits (e.g. prevents) communication of flow through the interior bore of the cross-over tool 112 at the downstream end 204 and diverts the slurry out of interior bore through slurry ports 208. Without the plug 230 or valve, fluid flows out the downstream end 204 of the cross-over tool 112. For example, frac fluid may be flowed out the downstream end 204 of the cross-over tool 112 and into the sand screens during fracturing operations.

The body 200, as illustrated, includes an outer member 210 and an insert 212 coaxially received within the outer member 210. The insert 212 defines multiple first apertures 224 extending through the insert 212, and the outer member 210 defines two second apertures extending through the outer member 210. Although illustrated as circumferentially extending slots, certain embodiments include first apertures 224 that have other shapes. Each of the two lateral slurry ports 208 includes four of the first apertures 224 aligned with one of the second apertures 226. The first apertures 224 in the insert 212 are smaller than the second apertures 226 in the outer member 210. The insert 212 receives a larger portion of the abrasive force applied to the body than the outer member 210 does. The lateral slurry ports 208, as shown, include a chamfer or cut back portion on the downstream edge, as well as on the lateral edges, of the second apertures 226. In certain instances, one or more of the edges shown chamfered can be square and/or one or more of the chamfered or square edges can have multiple chamfers (i.e., two or more chamfers of different angles) can be provided and/or be otherwise contoured or cut back. In certain instances, the chamfered and contoured edges reduce erosion to and flow losses at the edges of the port 208.

Figure 4:
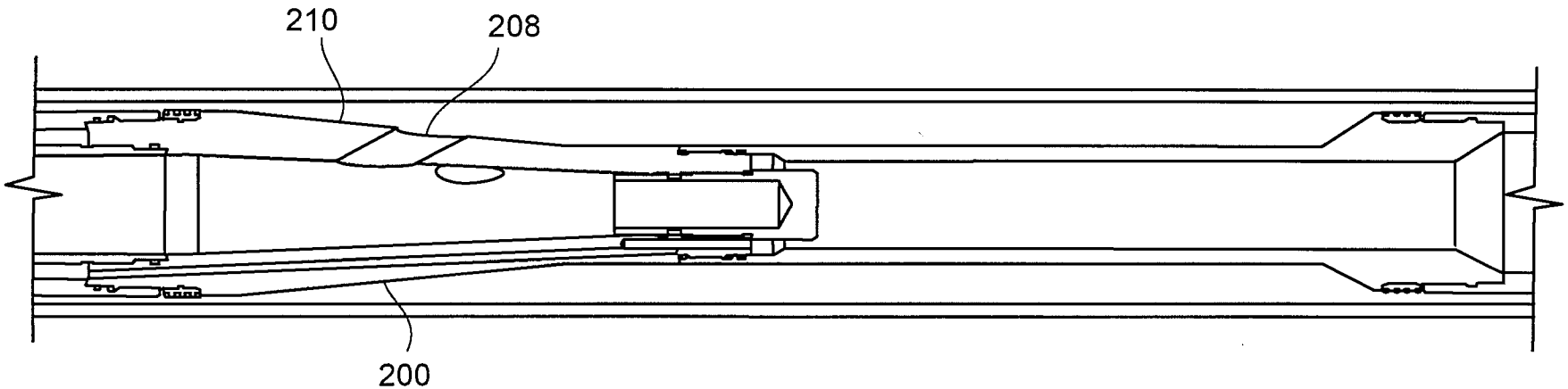
FIG. 4 is a cross-sectional view of another embodiment of a cross-over tool.

In certain embodiments, the body 200 is formed of a single unitary member rather two discrete members. For example, in certain embodiments, the body 200 includes outer member 210 but not an insert as shown in FIG. 4. In such embodiments, slurry ports 208 have a single-stage.

The discharge section 216 extends from an upstream end at an upstream edge 218 of a farthest upstream one of the at least one lateral slurry port 208 to a downstream end at a downstream edge 220 of a farthest downstream of the at least one lateral slurry port 208. In FIG. 2A, because the two slurry ports 208 are disposed symmetrically on opposite sides of axis 214, the discharge section extends from the upstream edge 218 of both of the slurry ports 208 to the downstream edge 220 of both of the slurry ports 208. In certain embodiments, multiple slurry ports are arranged axially offset from each other. For example, a first slurry port can be spaced apart from and disposed upstream of a second slurry port. In this example, the discharge section would extend from the upstream edge of the first slurry port to the downstream edge of the second slurry port.

The discharge section 216 of FIG. 2A has a generally conical configuration such that the exterior surface 222 of the body 200 tapers inward towards the axis 214 of the body with increasing downstream distance in the discharge section 216. A first transverse distance D1 measured from the central axis 214 of the body 200 to the exterior surface 222 of the body 200 (e.g., a radius of the exterior surface 222) at the upstream end of the discharge section is greater than a second transverse distance D2 measured from the central axis 214 of the body 200 to the exterior surface 222 of the body 200 (e.g., a radius of the exterior surface 222) at the downstream end of the discharge section. Although the whole circumference of the tubular body is tapered in the illustrated embodiment, in some embodiments, only a portion (e.g., 90 degree arcs centered on the slurry ports 208 or an arc that coincides in width to or is a bit wider than the slurry ports) of the body is tapered. The taper shown in FIG. 2A is substantially continuous and smooth over the length of the cross-over tool. In certain embodiments, the taper can be discontinuous, having one or more steps or shoulders from one transverse distance to another.

Both the first apertures 224 and the second apertures 226 are angled downstream such that fluid flowing outward from the axial bore 206 has an axial component directed in the downstream direction. The tapering of the body 200 and two-stage structure of the slurry ports 208 formed enable use of an reduced angle of the apertures relative to the axis 214. In certain embodiments, the reduced transverse velocity of the slurry exiting the slurry ports 208 can result in less erosion of the production string 210 and less restriction (i.e. flow losses) in the slurry.

Interior walls 228 of the production string 110 are generally parallel to axis 214 of the body 200. Thus, as the exterior surface 222 of the body 200 tapers inward, the annular flow area between the body 200 and the production string 110 increases. The increasing annular flow area can provide additional area for the flow exiting the cross-over 122 to more gradually turn from axial flow in the interior of the cross-over tool 122, through the lateral fluid ports 208, and to stabilize into axial flow in the annulus between the cross-over tool 122 and the production string 110. In certain instances, the more gradual redirection of flow reduces the erosive effect of the particulate-laden slurry (compared to cross-over tools with less annular area), because the slurry does not impinge as directly on the interior of the production string 110, nor does it reflect as directly on the exterior of the cross-over tool 122. In certain instances, the reduced erosive effect of the slurry allows greater flow rates of slurry to be communicated through the cross-over tool 122.

In effect, the body 200 defines a recessed flow area extending axially along the exterior surface 222 of the body 200 between the lateral slurry ports 208 and the downstream end 204 of the tool 122. A largest dimension measured along a radius of the cross-over tool at the upstream end of the body is larger than a largest dimension measured along a radius of the cross-over tool at the recessed flow area. Although shown as extending to the downstream end 204 of the cross-over tool 122, in certain embodiments, the recessed flow area extends towards but not to the end of the tool. For example, the recessed flow area can extend a fraction (e.g., approximately ⅓, between ⅓ to ½, or between ½ to ¾) of the distance between the slurry port 208 and the end of the tool.

In the illustrated embodiment, an extension 232 is configured with outer dimensions at an upstream end 234 of the extension that match the reduced dimensions. The extension 232 extends the axial length of the recessed flow area. In certain instances, the extension is approximately 4 times the diameter of downstream end 204 of the cross-over tool. In certain embodiments, the cross-over tool 122 can be manufactured with the structure of extension 232 incorporated as an integral feature of the cross-over tool 122.

The cross-over tool 122 includes threaded exterior (upstream end 202) and interior (downstream end 204) for connecting the cross-over tool to other components of the work string 118. The upstream end 202 of the cross-over tool 122 is configured to substantially match and accommodate the nominal thread size of the work string, while the downstream end 204 is substantially smaller. In certain instances, the threaded connection at the upstream end 202 of the cross-over tool 122 to the work string is 6 inches in diameter and the downstream end 204 is 4 inches in diameter.

The interior surface 236 of the body 200 can be configured with a generally conical configuration, tapering inward towards the axis 214 of the body 200 toward the downstream end 204. A transverse distance D3 measured from the central axis 214 of the body 200 to the interior surface 236 of the body 200 (e.g., a radius of the interior surface 236) at the upstream end 218 of the discharge section 216 is greater than a transverse distance D4 measured from the central axis 214 of the body 200 to the interior surface 236 of the body 200 (e.g., a radius of the interior surface 236) at the downstream end 220 of the discharge section 216. In certain instances, the reduced interior dimension reduces the flow area toward the downstream end 204 such that flow rate provided to the downstream most second apertures 226 is closer to and/or equal to the flow rate provided to the upstream most second apertures 226 than if the interior surface 236 were cylindrical. In certain embodiments, the slurry ports 208 can provide a substantially uniform axially distribution of the flow of the slurry and related erosive effects. For example, the flow of slurry can be substantially equal through first aperture 224*a* and first aperture 224*c*.

Figure 5:
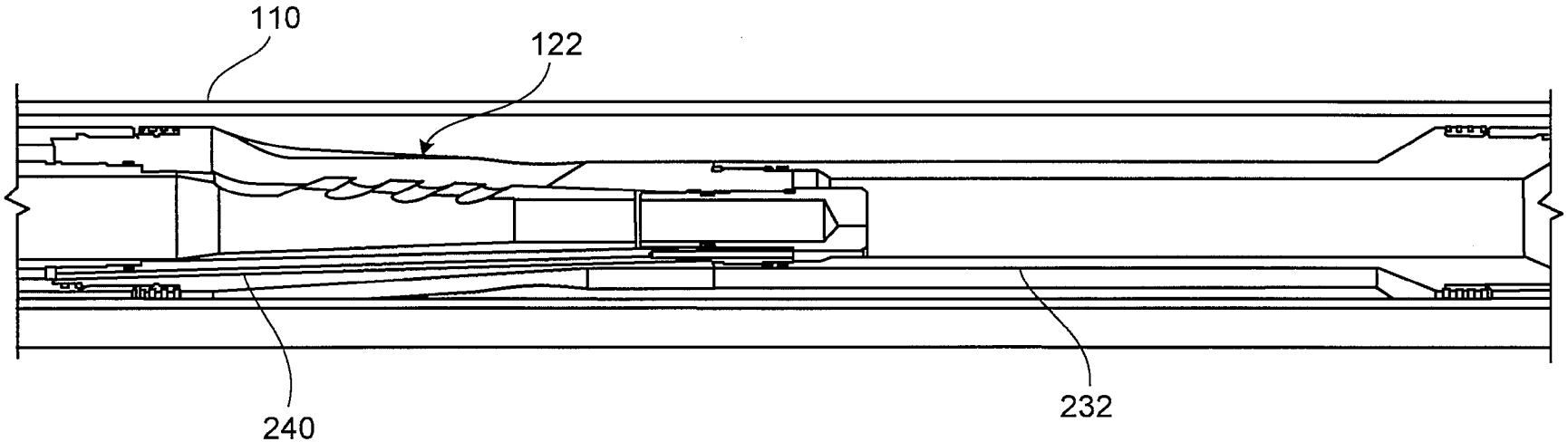
FIG. 5 is a cross-sectional view of another embodiment of a cross-over tool.

Referring to FIG. 5, the cross-over tool 122 can also includes return flow paths (240) which hydraulically connect the interior region of extension 232 with the annulus between the production string 110 and upstream portions of the work string 118. Certain embodiments of the cross-over tool do not include these optional return flow paths.

In certain embodiments, the outer member comprises a first material and the insert comprises a second material that is harder than the first material. For example, the outer member could be formed of steel and the insert could be formed of tungsten-carbide. Hardened materials such as, for example, tungsten-carbide and ceramics, can be more resistant to erosion. In certain embodiments, the insert comprises multiple hardened sleeves nesting within each other.

A number of embodiments of the invention have been described. Nevertheless, it will be understood that various modifications may be made without departing from the spirit and scope of the invention.

In certain embodiments, the production string includes a hardened sleeve (e.g., a sleeve with an interior surface coated with a hardened material or a sleeve made of a hardened material) at the location where the cross-over tool will be positioned during use. The hardened sleeve can be made of tungsten carbide.

In certain embodiments, more than one cross-over tool could be configured to be deployed in a series configuration. Such cross-over tools could be configured such that return channels in each cross-over tool would be positioned to engage return ports on an upper cross-over tool. In certain instances, an intermediate sub can be provided between adjacent cross-over tools to communicate the return channels of the adjacent cross-over tools.

Accordingly, certain embodiments are within the scope of the following claims.

What is claimed is:

1. A system for gravel packing a well bore, the system comprising:

a production string comprising a sand screen; and a cross-over tool for communicating a particulate-laden slurry from an interior of a downhole work string to an exterior of the downhole work string, the tool comprising:

an elongate tubular body having an upstream end and a downstream end, the body defining an interior, axial center bore open at the upstream end of the body to receive a flow of slurry;

a discharge section of the body, the discharge section including at least one lateral slurry port extending through the body from the interior bore to an exterior surface of the body, the discharge section extending from an upstream end of the discharge section at an upstream edge of a farthest upstream one of the at least one lateral slurry port to a downstream end of the discharge section at a downstream edge of a farthest downstream one of the at least one lateral slurry port; and a first transverse distance measured from a central axis of the body to the exterior surface of the body at the upstream end of the discharge section is greater than a second transverse distance measured from the central axis of the body to the exterior surface of the body at the downstream end of the discharge section.

2. The system of claim 1, wherein a largest dimension measured along a radius of the cross-over tool in the discharge section decreases with increasing distance from the upstream end of the discharge section towards the downstream end of the discharge section.

3. The system of claim 2, wherein a ratio of the average largest dimension of the discharge section to a maximum largest dimension of the discharge section of the tool is less than 0.75.

4. The system of claim 1, wherein a transverse distance measured from a central axis of the body to an interior surface of the body at the upstream end of the discharge section is greater than a transverse distance measured from the central axis of the body to the interior surface of the body at the downstream end of the discharge section.

5. The system of claim 1, wherein the body comprises an outer member and an insert coaxially received within the outer member, and wherein the outer member comprises a first material and the insert comprises a second material that is harder than the first material.

6. A cross-over tool for communicating a particulate-laden slurry from an interior of a downhole work string to an exterior of the downhole work string, the tool comprising:

an elongate tubular body having an upstream end and a downstream end, the body defining an interior, axial center bore open at the upstream end of the body to receive a flow of slurry;

a discharge section of the body, the discharge section including at least one lateral slurry port extending through the body from the interior bore to an exterior surface of the body, the discharge section extending from an upstream end of the discharge section at an upstream edge of a farthest upstream one of the at least one lateral slurry port to a downstream end of the discharge section at a downstream edge of a farthest downstream one of the at least one lateral slurry port; and a first transverse distance measured from a central axis of the body to the exterior surface of the body at the upstream end of the discharge section is greater than a second transverse distance measured from the central axis of the body to the exterior surface of the body at the downstream end of the discharge section.

7. The tool of claim 6, wherein the body defines a recessed flow area extending axially along the exterior of the body between the lateral slurry port and the downstream end, and a largest dimension measured along a radius of the cross-over tool at the upstream end of the body is larger than a largest dimension measured along a radius of the cross-over tool at the recessed flow area.

8. The tool of claim 7, wherein the recessed flow area extends around an entire perimeter of cross-over tool.

9. The tool of claim 6, wherein the tool has a largest dimension measured along a radius of the cross-over tool located between the discharge section and the upstream end of the tool.

10. The tool of claim 6, wherein a largest dimension measured along a radius of the cross-over tool in the discharge section decreases with increasing distance from the upstream end of the discharge section towards the downstream end of the discharge section.

11. The tool of claim 10, wherein a ratio of an average largest dimension of the tool divided by a maximum largest dimension of the tool is less than 0.75.

12. The tool of claim 10, wherein a ratio of the average largest dimension of the discharge section to a maximum largest dimension of the discharge section of the tool is less than 0.75.

13. The tool of claim 6, wherein a transverse distance measured from a central axis of the body to an interior surface of the body at the upstream end of the discharge section is greater than a transverse distance measured from the central axis of the body to the interior surface of the body at the downstream end of the discharge section.

14. The tool of claim 6, wherein the body comprises an outer member and an insert coaxially received within the outer member, and wherein the outer member comprises a first material and the insert comprises a second material that is harder than the first material.

15. The tool of claim 14, wherein the insert defines first apertures extending therethrough and the outer member defines second apertures extending therethrough and a plurality of first apertures are aligned with each second aperture.

16. A method of gravel-packing a well bore, comprising:

communicating a particulate laden slurry in a work string to an outside of the work string with a cross-over tool, the tool comprising:

an elongate tubular body having an upstream end and a downstream end, the body defining an interior, axial center bore open at the upstream end to receive a flow of slurry;

a discharge section of the body, the discharge section including at least one lateral slurry port extending through the body from the interior bore to an exterior surface of the body, the discharge section extending from an upstream end at an upstream edge of a farthest upstream one of the at least one lateral slurry port to a downstream end at a downstream edge of a farthest downstream one of the at least one lateral slurry port; and a first transverse distance measured from a central axis of the body to the exterior surface of the body at the upstream end of the discharge section is greater than a second transverse distance measured from the central axis of the body to the exterior surface of the body at the downstream end of the discharge section; and communicating the slurry into an annulus between a sand screen and the well bore.

17. The method of claim 16, further comprising returning fluid up through the cross-over tool.

* * * * *